US005658357A

United States Patent [19]

Liu et al.

[11] Patent Number: 5,658,357

[45] Date of Patent: Aug. 19, 1997

[54] PROCESS FOR FORMING COAL COMPACT WITHOUT A BINDER

[75] Inventors: Henry Liu; Yuyi Lin; Tom Marrero; Bill Burkett, all of Columbia, Mo.

[73] Assignee: The Curators of the University of Missouri, Columbia, Mo.

[21] Appl. No.: 407,240

[22] Filed: Mar. 21, 1995

[51] Int. Cl.[6] ..... C10L 5/00

[52] U.S. Cl. ..... 44/550; 44/280; 44/553; 44/596

[58] Field of Search ..... 44/550, 280, 553, 44/593, 596

[56] References Cited

U.S. PATENT DOCUMENTS

| | | | |
|---|---|---|---|
| 1,149,536 | 8/1915 | Phillips . | |
| 1,267,711 | 5/1918 | Sutcliffe . | |
| 1,597,570 | 8/1926 | Beaudequin . | |
| 1,597,571 | 8/1926 | Beaudequin . | |
| 2,162,064 | 6/1939 | Curran | 202/9 |
| 3,752,656 | 8/1973 | Rutkowski et al. . | |
| 3,800,428 | 4/1974 | Ahland et al. | 44/593 |
| 3,841,849 | 10/1974 | Beckmann | 44/593 |
| 4,169,711 | 10/1979 | Anderson | 44/559 |
| 4,179,269 | 12/1979 | Yates et al. . | |
| 4,208,188 | 6/1980 | Dick | 44/596 |
| 4,224,039 | 9/1980 | Smith et al. . | |
| 4,243,393 | 1/1981 | Christian . | |
| 4,331,446 | 5/1982 | Draper et al. . | |
| 4,478,601 | 10/1984 | Stephens . | |
| 4,494,962 | 1/1985 | Christie et al. . | |
| 4,650,496 | 3/1987 | Funk | 44/282 |
| 4,681,597 | 7/1987 | Byrne et al. | 44/579 |
| 4,702,745 | 10/1987 | Kamei et al. . | |
| 4,738,685 | 4/1988 | Goleczka et al. . | |
| 4,787,913 | 11/1988 | Goleczka et al. . | |
| 4,949,317 | 8/1990 | Liu et al. | 406/46 |
| 5,067,968 | 11/1991 | Davidson et al. | 44/550 |
| 5,238,629 | 8/1993 | Davidson | 264/123 |
| 5,435,813 | 7/1995 | Evans | 44/553 |

FOREIGN PATENT DOCUMENTS

| | | |
|---|---|---|
| 14841 | 9/1911 | United Kingdom . |
| 20679 | 1/1916 | United Kingdom . |
| 616857 | 1/1949 | United Kingdom . |

OTHER PUBLICATIONS

R. J. Piersol, State of Illinois Department of Registration and Education, Division of the State Geological Survey, "Briquetting Illinois Coals Without a Binder by Compression and by Impact—A Progress Report of a Laboratory Investigation", 1933, pp. 4–70 month unknown.

H. R. Gregory, Journal of the Institute of Fuel, "A New Process for Briquetting Coal Without a Binder", Sep. 1960, pp. 447–461.

D. C. Rhys Jones, Chemistry of Coal Utilization: Supplementary Volume, Chapter 16, "Briquetting", 1963, pp. 675–753 month unknown.

G. Ellison and B. R. Stanmore, Journal of Fuel Processing Technology, "High Strength Binderless Brown Coal Briquettes", 1981, vol. 4, pp. 277–289 and 291–304.

D. Makrutzki, et al., Aufbereitungs–Technik, "Continuous briquetting of hard coal without a binder", 1989, No. 7, pp. 405–412.

(List continued on next page.)

*Primary Examiner*—Prince Willis, Jr.
*Assistant Examiner*—Cephia D. Toomer
*Attorney, Agent, or Firm*—Senniger, Powers, Leavitt & Roedel

[57] ABSTRACT

A process for forming durable, mechanically strong compacts from feed mixtures comprising solid particles in contact with a liquid (e.g., carboniferous particles in contact with water) which does not require use of a binder is disclosed. The process comprises applying a compressive stress to the feed mixture either by compacting the feed in a mold or by extruding the feed through the die of a suitable extrusion apparatus while controlling certain process parameters, including the moisture content and the zeta potential of the particulate feed. The process can be used to form large, cylindrically-shaped compacts from coal particles (i.e., "coal logs") so that the coal can be transported in a hydraulic coal log pipeline or by conventional means.

20 Claims, 11 Drawing Sheets

OTHER PUBLICATIONS

Brett Gunnink and Zhuoxiong Liang, Proceedings of the 17th International Conference on Coal Utilization and Slurry Technologies, "Compaction of Binderless Coal Logs for Coal Pipelines", 1992, pp. 677–686.

M. R. Miller, G. L. Fields, R. W. Fisher and T. D. Wheelock, Proceedings of the 16th Biennial Conference, IBA, "Coal Briquetting Without a Binder", pp. 325–349 Date Unknown.

Brett Gunnink and Zhuoxiong Liang, Journal of Fuel Processing Technology, "Compaction of Binderless Coal for Coal Log Pipelines", 1994, vol. 37, pp. 237–254 Date Unknown.

Henry Liu, et al., 19th International Technical Conference on Coal Utilization and Fuel Systems, "Coal Log Technology for Handling and Transporting Coal Fines", 1994, pp. 1–5.

Jayanth J. Kananur, Masters of Science Thesis, University of Missouri –Columbia, "Compaction of High Strength Binderless Coal Logs for Pipeline Transportation", Aug. 1994 pp. 1–106.

Zhuoxiong Liang, Masters of Science Thesis, University of Missouri –Columbia, "Compaction of Binderless Coal for Coal Log Pipelines", May 1993, pp. 1–132.

M. V. Chari, Bechtel Group, Inc., "Thermal Upgrading of Law—Rank Coal a Process–Screening Study", Research Project 2221–11, Final Report, Mar. 1986, pp. 1–4, A1–A3, B1–B3, C1–C3, D1–D3 and R1–R2.

VARIATION OF ZETA POTENTIAL WITH CONCENTRATION OF HCl IN PRB COAL

EFFECT OF ZETA POTENTIAL ON DENSITY OF COMPACTED COAL LOGS BEFORE WATER ABSORPTION.

EFFECT OF ZETA POTENTIAL ON WEIGHT GAIN OF COMPACTED COAL LOGS DUE TO WATER ABSORPTION FOR AN HOUR AT 3447.48 kPa PRESSURE

EFFECT OF ZETA POTENTIAL ON TENSILE STRENGTH OF COMPACTED COAL LOGS BEFORE AND AFTER WATER ABSORPTION (ADDITIVE: POLYOX)

EFFECT OF ZETA POTENTIAL ON TENSILE STRENGTH OF COMPACTED COAL LOGS BEFORE AND AFTER WATER ABSORPTION (ADDITIVE: HCl)

WEIGHT LOSS OF COAL LOGS CIRCULATED THROUGH A 55 mm - DIAMETER STEEL PIPE LOOP (ADDITIVE: POLYOX)

WEIGHT LOSS OF COAL LOGS CIRCULATED THROUGH A 55 mm - DIAMETER STEEL PIPE LOOP (ADDITIVE: HCl)

PROCESS FOR FORMING COAL COMPACT WITHOUT A BINDER

The U.S. Government has rights in this invention pursuant to Contract No. ECD-9108841 awarded by the National Science Foundation.

BACKGROUND OF THE INVENTION

The present invention relates to a process for forming agglomerates or compacts from a feed material comprising solid particles in contact with a liquid (e.g., carboniferous particulates such as bituminous, subbituminous and lignite coal and/or coal fines in contact with water) which does not require the use of a binder. The process of the present invention can be used to form cylindrically-shaped compacts from carboniferous particles (i.e., "coal logs") so that the material can be handled and transported more easily by conventional means (e.g., truck, barge, conveyor etc.) or by a hydraulic coal log pipeline, such as that described and shown in U.S. Pat. No. 4,946,317 (Liu et al.).

Coal is widely used as a fuel source for generating heat. Coal is often transported over long distances from the mining area to the end user. In order that coal remain an attractive fuel source, it is imperative that means be devised to transport coal efficiently and economically.

Coal fines are extremely small coal particles typically having a diameter of about 1 mm or less. Coal fines are produced in significant quantities by the washing of mined coal and possess a potentially significant heating value. However, their large water content often makes them difficult to handle and use as a fuel source. Currently, because coal fines cannot be dewatered and processed into a form which may be easily transported economically, they are usually collected in tailing ponds as a waste product of coal mining or coal preparation operations rather than being recovered. Coal fines represent a significant environmental problem which would be reduced if a process were available which could economically convert coal fines into a usable fuel source.

It has been suggested that mined coal particles, coal fines and other carboniferous particles could be processed into a more easily transportable and usable form by fabricating agglomerates or compacts from the material. It is generally known that loose particles of coal can be formed into agglomerates or compacts (e.g., briquettes as well as other shapes) by compacting or extruding a mixture of coal particles and a significant amount of a binder additive (e.g., pitch). However, the use of binders in forming coal compacts is generally undesirable because the binders add to the expense and complexity of the process, cause increased smoking when the compact is subsequently burned and render the compact generally unpleasant to handle. As a result, binderless coal compaction or extrusion processes have been developed. However, prior art binderless processes are energy intensive, expensive and often do not produce a compact having the mechanical strength characteristics necessary to withstand the rigors of handling and transport without breaking. Furthermore, prior art compaction and extrusion processes are not capable of economically producing a suitable compact from coal fines.

SUMMARY OF THE INVENTION

Among the objects of the present invention, therefore, are the provision of a process for efficiently forming compacts from a feed material comprising solid particles in contact with a liquid such as carboniferous particles in contact with water; the provision of such a process which produces compacts that have sufficient mechanical strength to withstand the rigors of handling and transport; the provision of such a process which does not require use of a binder; the provision of such a process capable of transforming coal fines from tailing ponds into a usable fuel source which can be easily handled and transported; and the provision of such a process which is economical and commercially viable.

Briefly, therefore, the present invention is directed to a process for preparing a compact from a feed material having a zeta potential and comprising solid particles in contact with a liquid. The process comprises reducing the zeta potential of the feed material, and thereafter forming the feed material into the compact.

The present invention is further directed to a process for preparing a compact from a feed material comprising carboniferous particles and water. The process comprises selecting a compressive stress greater than about 5,000 psig to be applied to the feed material to form the compact. The moisture content of the feed material is then increased such that when the selected compressive stress is applied to the feed material, water is expressed from the material. Thereafter, the selected compressive stress is applied to the feed material to compress the feed material into a solid compact.

The present invention is further directed to a process for preparing a compact from a feed material comprising carboniferous particles and water. The process comprises compacting the particulate feed in a mold by applying a compressive stress of at least about 5,000 psig to the feed material to form a compact having a shape imparted by the mold. The compressive stress is maintained until at least about 95 wt % of the amount of water which could potentially be expressed from the feed under the compressive stress is expressed from the feed.

The present invention is further directed to a process for making an extrudate from a feed material comprising carboniferous particles and water. The process comprises applying an extrusion force to the feed material to force the material through a die of an extrusion apparatus and form the extrudate. The extrudate exits the die into a cell comprising a liquid maintained at a pressure less than the die pressure of the extrusion apparatus such that the extrudate is forced through the die and into the liquid.

Other objects and features of this invention will be in part apparent and in part pointed out hereinafter.

BRIEF DESCRIPTION OF THE DRAWINGS

FIG. 8(*b*) is a graph showing the effect of zeta potential of the feed mixture on the splitting tensile strength of the coal logs produced from the feed mixture in Example 3 using hydrochloric acid as a zeta potential modifying agent in the feed mixture.

FIG. 9(*b*) is a graph showing the effect of zeta potential of the feed mixture on the weight loss of coal logs produced from feeds containing hydrochloric acid as a zeta potential modifying agent upon being subjected to the wear test in Example 3 as a function of the number of cycles through the recirculating pipe loop.

DETAILED DESCRIPTION OF THE PREFERRED EMBODIMENTS

Figure 1:
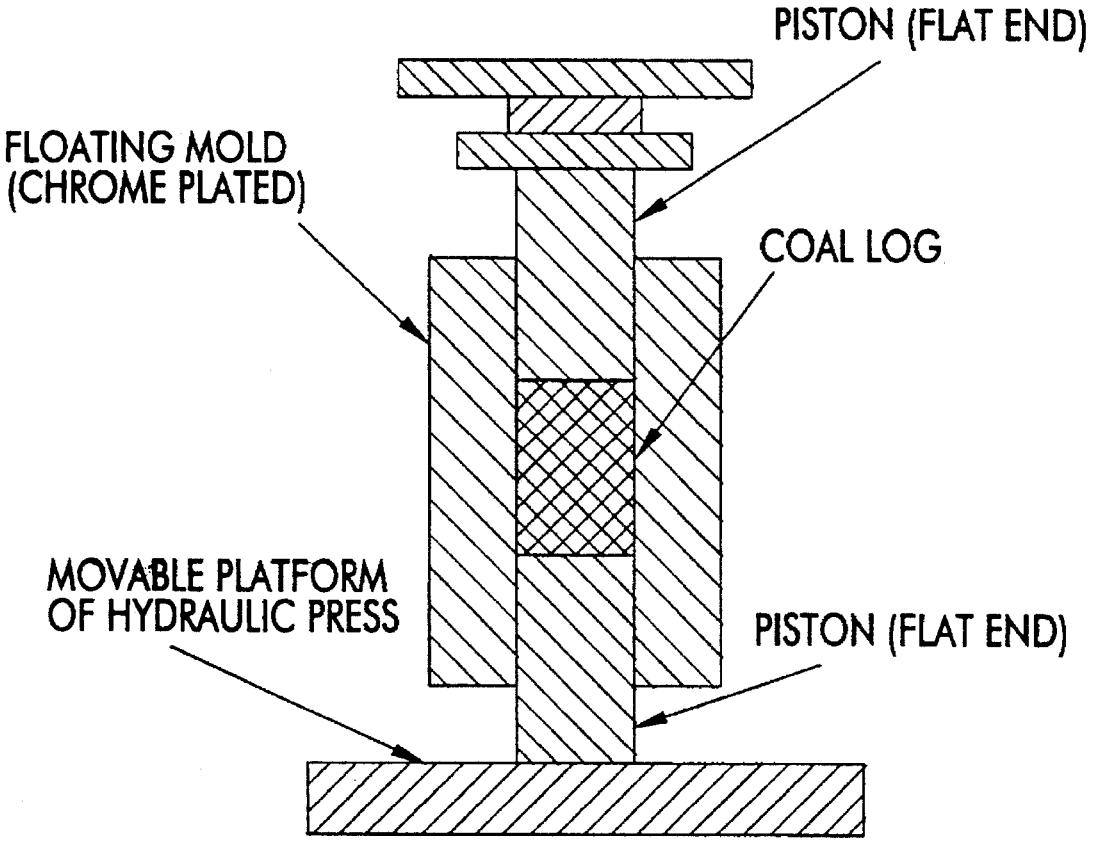
FIG. 1 is a schematic of the compaction apparatus used to make coal log compacts in Example 3.

In accordance with the present invention, a process for forming compacts from a feed comprising solid particles (e.g., coal particles, coal fines and other carboniferous particles) has been devised. As used herein the term "compact" means a consolidated agglomeration of solid particles formed by applying a compressive stress to the particulate feed either by compacting the feed in the mold of a suitable compaction apparatus (e.g., a roller press, a rotary tabletting press, a pelletizing machine or a briquetter) or by extruding the feed. The process of the present invention comprises applying a compressive stress to the feed either by compacting the feed in a mold or by extruding the feed through the die of a suitable extrusion apparatus while controlling certain process parameters, including the moisture content and the zeta potential of the particulate feed. The process is described in detail below.

We have found that a particulate feed comprising carboniferous particles can be formed into a mechanically strong compact by either compacting the feed in a mold or by extruding the feed if a sufficient amount of water is present in the feed material such that the compact formed is substantially saturated with water. Water in the particulate feed serves three primary purposes, including: lubrication and softening of the carboniferous particles making it easier to compress or extrude, provision of a binding effect which holds the carboniferous particles together and imparts mechanical strength in the compact and expulsion of air, a non-condensable gas, from the compact. Air tends to become trapped and pressurized within the compact, weakening its structure. Water present in the feed displaces or expels air from the compact making the compact stronger.

In order to form substantially water saturated compacts, the feed material comprising solid particles in contact with water must have sufficient moisture content. The optimum amount of water present in the feed may be determined by routine experimentation as explained below.

Whether water is expressed from the compact depends on both the moisture content of the feed and the magnitude of the compressive stress applied to the feed material. In order to provide a compact of sufficient mechanical strength, the compressive stress applied to the feed should be at least about 5000 psig. Stronger compacts are obtained by increasing the compressive stress applied to the feed. Thus, depending upon the mechanical strength desired in the compact, the compressive stress applied to the feed may be greater than 5000 psig, e.g., 10,000 psig, 15,000 psig or more. It is preferred, however, that the compressive stress applied to the feed not exceed about 20,000 psig; otherwise the compressive stress applied to the feed tends to crush the carboniferous particles and not simply consolidate or compact the feed.

A sample of the feed material as obtained from the source is subjected to a selected compressive stress (≧5,000 psig) which will provide the desired strength characteristics in the compact. If no water is expressed (expelled), the initial moisture content of the particulate feed is too low and the test is run again, but this time with a sample in which the moisture content has been incrementally increased relative to the previous sample. Testing is continued in this manner until a sample is found from which some water is expressed during compression of the feed, with the optimum moisture content being that amount of moisture at which the particulate material will express a very small quantity of water when subjected to the compressive stress. In this fashion, substantially water saturated compacts can be produced.

If it is determined that water must be added to the feed material obtained from its source in order to produce substantially water saturated compacts, the feed mixture is preferably allowed to stand for a period of time after additional water is added before compressing the feed. This standing period, referred to as tempering, allows the added water to be absorbed into the particulate material and provides a stronger compact. The tempering period can vary significantly in the practice of the present invention. Preferably, the feed material is tempered for a period of at least about 10 minutes, more preferably for a period of at least about 1 hour after the moisture content of the feed material has been increased by addition of water.

For example, coal obtained from Powder River Basin (Wyoming) was obtained from its source with an initial moisture content in the range of 25–28 wt %. Based upon our experimental studies, the preferred moisture content for compaction of this type of coal into cylindrically shaped coal compacts (i.e., "coal logs") is about 30 wt %. Thus, in the case of Powder River Basin coal, additional water is added to the feed until the moisture content is approximately 30 wt %.

Similarly, Illinois coal which we tested was harder and drier than the Powder River Basin coal. Accordingly, more water should be added to prepare coal logs having the desired strength. For this coal, the preferred moisture content of the particulate feed is about 33 wt %.

If it is determined that the feed material contains sufficient moisture content to produce water saturated compacts at the selected compressive stress as obtained from the source, there is no need to add additional water to the feed. To obtain a compact of maximum strength, it would simply be compacted with the selected compressive stress and maintained under such stress until water ceased to be expelled from the feed material. Because the time required for the complete cessation of the release of water from the compact may be impractically long, in some instances it will be preferred to maintain the compressive stress applied to the feed material only for a period of time sufficient to express at least about 95 wt % of the maximum amount of water which could potentially be expressed from the feed at the selected compressive stress. Alternatively, the compressive stress applied to the feed can be increased.

It is desirable to limit the size of coal particles in the feed material to about 1/20 of the diameter of the compact when forming log-shaped compacts. Preferably, the compacts are produced from feed materials having a wide particle size distribution which maximizes packing density and results in a denser, stronger compact. In the case of feed material comprising coal fines, the coal fine particles predominantly have a size less than about 1 millimeter.

Using the process of the present invention, we have extruded coal fines having an initial moisture content of as much as 18 wt %. The compact (extruded logs) had approximately 11% of water. We were also able to compact coal fines in a cylindrical mold to make logs. The feed material comprising coal fines had a moisture content of about 12 to about 16 wt %, and the compact formed had a moisture of about 5 to about 9 wt %. Thus, significant dewatering of the coal fines took place as a result of subjecting the coal fines to both compaction and extrusion.

When a solid particle is immersed in a liquid, either positive or negative electric charges become adsorbed onto the surface of the particle. An electric double layer at the solid-liquid interface is produced which comprises a close-packed array of charges attached to the surface of the particle and a diffuse layer of charges of opposite sign extending into the liquid. There is an electrokinetic potential gradient across the double layer which is known as the zeta potential. The zeta potential of any solid is proportional to the amount of charge adsorbed on the surface of the solid.

When carboniferous particles are immersed in an aqueous environment, a charge layer (usually negative) develops on the surface of the particles by dissociation of functional groups (COOH, C=O, COH) from the surface of the particle and/or by preferential adsorption of ions from the water. This charged layer attracts charges of opposite sign from the liquid to form an electric double-layer and a corresponding zeta potential. When a feed material comprising carboniferous particles in contact with water are brought in close proximity to each other, such as when a compressive stress is applied to the feed during compaction or extrusion to form a coal compact, the charges on the particles which are of the same sign tend to repel each other electrostatically. This makes it difficult for the particles to agglomerate and form a mechanically strong compact. Consequently, a greater compressive stress is required to overcome this electrostatic force in order to produce a mechanically strong compact.

In accordance with the present invention, it has been discovered that by reducing the surface charges on the solid particles so as to substantially reduce (neutralize) the zeta potential in a particulate feed comprising a mixture of solid particles in contact with water, the repulsive forces between particles which tend to prevent agglomeration and consolidation upon application of a compressive stress to the feed can be significantly reduced. By substantially reducing the zeta potential, the feed can be compacted or extruded by applying a compressive stress to the feed to produce compacts having improved mechanical strength and greater wear resistance at a lower compressive stress.

Preferably, the zeta potential of a particulate feed having a zeta potential greater than about 10 millivolts or less than about −10 millivolts is reduced to less than about 10 millivolts and greater than about −10 millivolts, more preferably reduced to less than about 5 millivolts and greater than about −5 millivolts, and even more preferably reduced to less than about 2 millivolts and greater than about −2 millivolts. Optimally, the zeta potential of the particulate feed is substantially neutralized to 0 mV.

The zeta potential of a particulate feed comprising solid particles in contact with a liquid (e.g., an aqueous mixture of carboniferous particles and water) can be reduced by adding a water-soluble, zeta potential modifying agent to the feed. Suitable water-soluble, zeta potential modifying agents may comprise one or more of the compounds selected from the group consisting of acids (e.g., hydrochloric acid), bases (e.g., NaOH) polymers (e.g., polyethylene oxide), surfactants (e.g., detergents), and electrolytes (e.g., aluminum chloride, calcium chloride). An especially preferred zeta potential modifying agent for use in the practice of the present invention is a series of polyethylene oxide polymers having molecular weights ranging from about 100,000 to several million sold under the trade name POLYOX and available from Union Carbide.

Zeta potentials of solid-liquid systems are calculated from the electrophoretic mobilities, i.e., the rates at which the solid particles travel between charged electrodes placed in the solution. Microelectrophoresis apparatus which measure the zeta potential of systems comprising a solid suspended in a liquid are commercially available, such as the Zeta Meter 3.0 System manufactured by Zeta Meter, Inc. The zeta potential of the feed is controlled within a desired range by the selection and concentration of the water-soluble, zeta potential modifying agent added to the feed as determined by routine experimentation.

We have found that the process of the present invention may be advantageously practiced by extruding the feed material into a body of liquid, preferably a pressurized body of water. An extrusion force is applied to the feed material to force the material through a die of an extrusion apparatus and form the an extrudate, The extrudate exits the die into a cell comprising a liquid, the liquid being maintained at a pressure less than the die pressure of the extrusion apparatus such that the extrudate is forced through the die and into the liquid. If coal logs are extruded directly into water, such as by connecting the outlet of an extruder to a pipe containing water under pressure, stronger compacts may be produced. The water at the extruder outlet appears to help in two ways. First, it provides buoyancy for the extruded coal logs. The buoyancy makes the extrudate weightless, thereby allowing very long loss to be formed without breakage or deformation by gravity or weight. This advantage is achieved whether or not the liquid in the cell is pressurized. Second, the liquid in the cell at the extruder outlet, when maintained under pressure such as in a pressure vessel or pipe, provides a back pressure at the extruder outlet. The back pressure serves to further compress the feed material, resulting in a stronger compact.

Among the advantages of this process of making coal logs, briquettes, pellets and other shaped products, therefore, may be noted the following:

(1) Binderless products formed without heating—other binderless processes require heating of coal to high temperature (often above 100° C.). The present process can make coal logs of suitable strength and quality even at room temperature. This conserves energy and reduces cost.

(2) Water resistant-other binderless processes produce logs or briquettes that disintegrate in water under pressure. This process produces logs that don't disintegrate in water. The logs produced are suitable of hydraulic transport by pipeline. The reason that coal logs produced by this process don't disintegrate in water is that they are saturated with water when they are made (extruded or compacted). In contrast, dry logs with air in voids and pores absorb water. The absorption causes damage to logs.

(3) Simple and low cost-because no binders (other than water) and no heating is required, the process is simple and economical. It may be used for briquetting Wyoming and other coal-including subbituminous, bituminous and lignite coals. It may also be applicable to briquetting other materials such as power plant ashes.

The present invention is illustrated by the following examples which are merely for the purpose of illustration and are not to be regarded as limiting the scope of the invention or manner in which it may be practiced.

EXAMPLE 1

In this Example, coal compacts were produced by compacting coal fines in a cylindrical mold without use of a binder in order to determine the feasibility of using compaction as a means of forming the fines into coal compacts for greater ease in handling and transport.

The coal fines used in this Example were ash-pond tailings supplied by Southern Company Services, Inc. As received, the coal fines contained 12 to 16 wt % water. A proximate analysis of the coal fines according to standard analysis procedures was conducted. The results of the analysis are shown in Table 1.

TABLE 1

Proximate Analysis of Raw Ash-Pond Tailings

| Mesh | Weight (%) | Ash (wt %) | Volatile Matter (wt %) | Fixed Carbon (wt %) | Heating Value (Btu/lb) |
|---|---|---|---|---|---|
| +16 | 11.81 | 13.33 | 28.60 | 58.07 | 12062 |
| +30 | 24.26 | 15.12 | 27.94 | 56.94 | 11710 |
| +50 | 25.74 | 26.08 | 24.30 | 49.62 | 9728 |
| +70 | 12.36 | 50.57 | 18.43 | 31.00 | 5131 |
| −70 | 25.83 | 67.12 | 13.99 | 18.89 | 2949 |
| Total | 100.0 | 35.5 | | | 8797 |

Table 1 shows that the coal fines were high in ash content, with most of the minerals (i.e., ash) concentrated in the tailings which passed through a 70 mesh sieve. The heating value of the tailings, when dried, is approximately 8,800 Btu/lb. This shows that if this material could be dewatered and compacted in an economic manner, it could be quite valuable as a fuel source.

The fines as received were compacted in a cylindrical mold both at room temperature (about 20° C.) and at 105° C. A compressive stress ranging from 9,658 to 19,316 psig was applied to the fines to form the coal log compact. The density and moisture content of the formed compacts were determined as was the extent of dewatering as a result of the compaction process. The extent of dewatering was determined using the formula below:

Moisture Content of Fines—Moisture Content of Compact× 100% Moisture Content of Fines The results are shown below in Table 2.

TABLE 2

Binderless Coal Fine Compact Test Results

| Coal Log I.D. No. | Compaction Pressure (psig) | Compaction Temperature (C°) | Log Density (gm/cc) | Log Moisture (wt %) | Initial Moisture (wt %) | Dewatering (wt %) |
|---|---|---|---|---|---|---|
| 2 | 19,037 | 20 | 1.36 | 4.53 | 12.5 | 66.3 |
| 4 | 19,104 | 20 | 1.39 | 6.01 | 15.8 | 65.9 |
| 5 | 19,029 | 20 | 1.38 | 7.02 | 14.7 | 56.2 |
| 6 | 19,163 | 20 | 1.38 | 5.90 | 13.0 | 58.0 |
| 8 | 18,946 | 20 | 1.33 | 6.52 | 12.7 | 52.0 |
| 11 | 19,054 | 20 | 1.35 | 6.74 | 13.5 | 53.7 |
| 12 | 18,937 | 20 | 1.33 | 8.52 | 14.2 | 43.7 |
| 13 | 19,015 | 20 | 1.34 | 7.56 | 12.7 | 43.5 |
| 14 | 19,025 | 20 | 1.33 | 7.32 | 12.1 | 42.6 |
| 15 | 18,976 | 20 | 1.33 | 6.5 | 12.1 | 49.2 |
| | | | | Average Percent Dewatering | | 53.1 |
| 7 | 9,658 | 105 | 1.35 | 3.82 | 13.1 | 73.7 |
| 9 | 19,316 | 105 | 1.35 | 4.47 | 12.8 | 68.2 |
| | | | | Average Percent Dewatering | | 70.9 |

It is interesting to see from these results that approximately half of the water initially present in the coal fines was expelled by compaction, resulting in coal logs having only about 5 to about 9 wt % water. More moisture could have been expelled during compaction had the moisture content of the fines been greater. This demonstrates that the compaction process is highly effective in dewatering. The density of the compacted logs ranged from 1.33 to 1.39 gm/cc.

The coal log compacts were immersed in a static water bath pressurized to about 1000 psig for over 24 hours to evaluate their resistance to water absorption and ability to retain mechanical strength. The coal log compacts lost considerable mechanical strength and thus are not suitable for transport in a hydraulic coal log pipeline. However, they were sufficiently strong and durable for transportation by other modes including train, truck, barge, ship and conveyor belt. This is significant since many coal suppliers and utilities could use compaction as an economic way to dewater coal fines and produce a compact for handling and transport by conventional means. The room-temperature, binderless compaction process herein appears promising for such applications.

EXAMPLE 2

The same coal fine material used in Example 1 was made into coal log compacts using a binderless extrusion process. A two-inch auger extruder was employed as the extrusion apparatus. Several parameters were varied in the extrusion process, including: die diameter, auger rotational speed and the moisture content of the coal fines. All of these had a strong effect on the quality of the extruded compact. Although no auxiliary heat was supplied to either the coal fine feed or the extrusion apparatus, variable degrees of heat were generated by the extrusion process due to frictional loss. The heat generated by the extrusion process effected the temperature and the quality of the logs produced. The optimum diameter of the die for the 2-inch extruder was approximately 1.6 inches. The optimum moisture for the coal fines fed to the extruder was about 14 wt %. Coal fines having a moisture content greater than about 18 wt % were too wet and they did not form quality compacts. Coal fines having a moisture content less than about 12 wt % were difficult to extrude and the extruder became clogged. The optimum speed of the auger was about 4 rpm. The best logs produced had tensile and compressive strengths of 52 and 176 psi respectively. Immediately after being formed, the logs had a moisture content of approximately 11 wt %. The moisture content of the logs fell to around 5 wt % after air-drying for 48 hours. Drying of logs in air caused cracks that weakened the log strength except in cases where the log was very soft when first extruded.

Based on this Example, it can be concluded that binderless extrusion of coal fines at room temperature is feasible provided that the right die and the right amount of moisture is present in the coal fines. The logs appear sufficiently strong for conventional handling and transportation by rail, truck, barge, ship and conveyer belt. However, they are unsuitable for transport in a hydraulic coal log pipeline because they weaken and disintegrate upon lengthy exposure to high-pressure water.

Both the binderless compaction and the binderless extrusion processes described in Examples 1 and 2 can produce coal logs from coal fines at room temperature that are sufficiently strong for ordinary handling, and for transportation by truck, train, barge, ship and conveyor belt.

EXAMPLE 3

The purpose of this Example is to demonstrate the effect of the zeta potential of a feed mixture comprising coal particles in contact with deionized water on the strength of coal log compacts formed by compacting the feed mixture. In order, to observe clearly the effect of the zeta potential of the feed on compact strength, other factors affecting the strength of the compact including the coal type, particle size distribution in the feed, compaction conditions and moisture content of the feed were held constant. Only the zeta potential of the feed mixture was altered by adding water-soluble, zeta potential modifying agents to the feed mixture.

The coal used was a subbituminous coal from the Powder River Basin in Wyoming. This coal is favored by many electric utilities in the United States due to the low cost of this coal, and its low sulfur content. The proximate analysis of Powder River Basin coal is given in Table 3 and the particles size distribution is given in Table 4.

TABLE 3

Proximate Analysis of Coal Used in Example 3.

| Properties | As Received (wt %) | Dry Basis (wt %) |
|---|---|---|
| Total Moisture | 26.43 | — |
| Volatile Matter | 30.31 | 41.20 |
| Fixed Carbon | 38.76 | 52.70 |
| Ash | 4.50 | 6.11 |
| Heating Value (MT/kg) | 20.51 | 27.88 |
| Inherent Moisture | 15.53 | 15.53 |

TABLE 4

Particle Size Distribution of Coal Used in Example 3

| Mesh Size | | Percentage (wt %) |
|---|---|---|
| −60 | +80 | 25 |
| −80 | +100 | 10 |
| −100 | +140 | 30 |
| −140 | +170 | 10 |
| −170 | +200 | 10 |
| −200 | | 15 |

Two additives were used to alter the zeta potential of the feed mixture: polyethylene oxide sold under the trade name POLYOX by Union Carbide and hydrochloride acid. Polyethylene oxide is a high molecular weight polymer. POLYOX brand polyethylene oxide is a water soluble resin, having a molecular weight of approximately $5\times10^6$. Polyethylene oxide is nonionic, and Changes the zeta potential of the feed mixture by affecting ions adsorption and the structure of the coal-water interface. POLYOX is also an effective chemical for producing compacts having reduced drag for transport in hydraulic coal log pipelines. Hydrochloric acid decreases the pH value of the feed mixture, neutralizing the negative charge on the surface of the coal particles and reducing the zeta potential of the feed mixture by hydrogen ion adsorption.

Four aqueous solutions of POLYOX having concentrations of 25, 45, 65 and 100 mg/L were prepared along with three aqueous solutions of hydrochloric acid having a pH of 2.0, 2.20 and 5.78, respectively. A sample of pure deionized water without POLYOX or hydrochloric acid addition was also prepared as a standard. Each of the solutions was then mixed with an equal weight of coal particles to form a feed mixture. The mixtures were allowed to stand 24 hours at room temperature (about 22° C.) so the zeta potential of the mixture could reach a constant value. The mixtures were then filtered, and the pH, specific conductance, and zeta potential of the filtrate were measured using a pH-meter and a zeta potential meter (Zeta Meter 3.0 System). The pH value of the feed mixture containing coal and deionized water was 6.3, and had a zeta potential of about −15.5 mV. Once the moisture content of the feed mixtures reached a desired value (25 or 45 wt %) at room temperature in air, the mixtures were compacted into coal logs.

Coal log compacts were produced at room temperature (around 22° C.) using a 267 kN (60,000 lb) hydraulic press and a cylindrical mold having an inside diameter of 44.5 mm. A schematic of the compaction apparatus used in this Example to form coal logs is shown in FIG. 1. The logs produced had a diameter of about 45.5 mm and a length of about 73.5 mm. The peak compressive stress applied to the feed mixtures was about 138 MPa (20,000 psi) and was applied for a load holding time of about 7 minutes. The loading rate and the unloading rate were about 71.2 kN/min and about 42.7 kN/min, respectively.

A total of 80 coal logs were compacted in this Example. They were evaluated to determine their density, moisture content, water absorption, tensile strength and wear resistance.

The density of the coal logs was determined by weighing the logs and measuring their dimensions. A torsion-type moisture instrument (CSC Moisture Balance Model No. 26680-000) was used to measure the moisture of the raw coal, the coal water mixture and the coal logs. Splitting tensile strength of the logs was measured according to the American Society for Testing Materials (ASTM) standard (1993). The procedure given in this standard was followed in this Example. The splitting tensile strength (T) was calculated as follows:

$$T=\frac{2P}{\pi DL}$$

where T is the splitting tensile strength (Pa); D is the diameter of the coal log (m); L is the log length (m) and P is the failure load (N).

Figure 2:
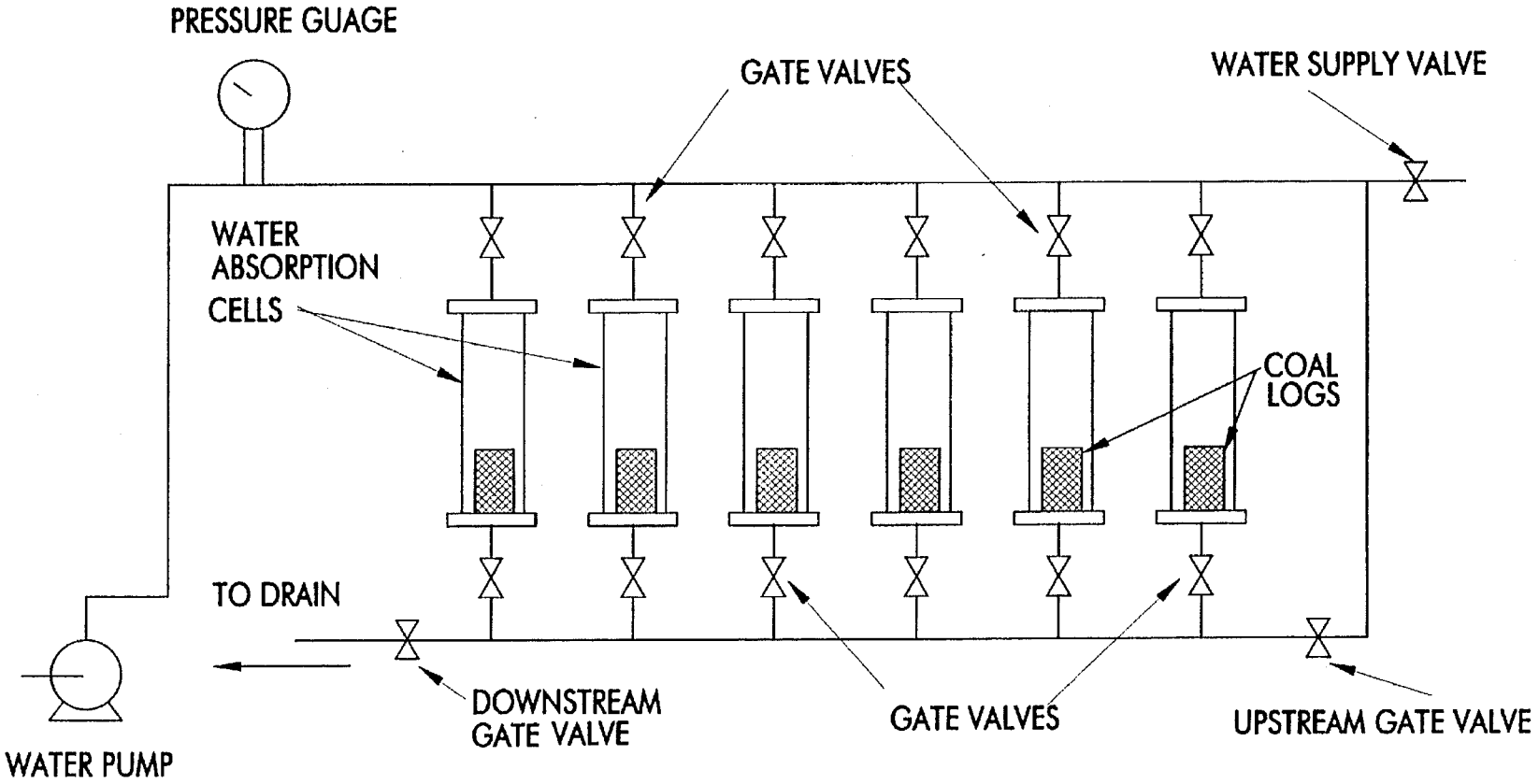
FIG. 2 is a schematic of the apparatus used to conduct the water absorption test in Example 3.

The water absorption test was conducted by immersing coal logs in sealed pressure cells containing pressurized water. A schematic of the apparatus used to conduct the water absorption test is shown in FIG. 2. After immersion, the water pressure in the cells was raised to 3447 kPa gauge (500 psig) for about one hour. This caused the logs to become saturated with water. The weight gain of any coal log due to water absorption was defined as follows:

$$G=\frac{W_a-W_i}{W_i}$$

where G is weight gain (%); $W_a$ and $W_i$ are the weight of the log after water absorption and the initial weight, respectively.

Figure 3:
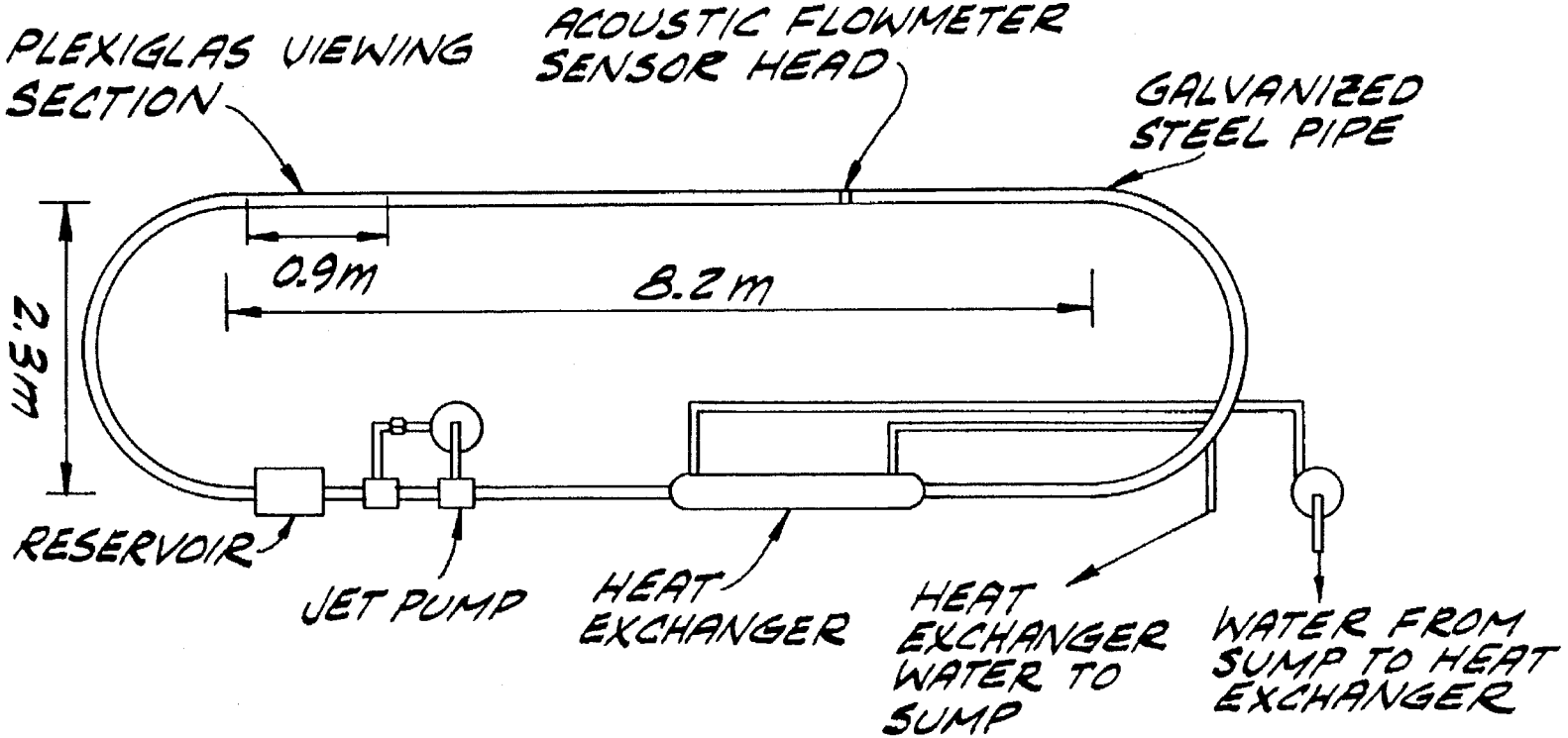
FIG. 3 is a schematic of the apparatus used to conduct the wear test in Example 3.

The coal log wear test was conducted in a 23 m long 55 mm diameter steel pipeline recirculating loop driven by a jet pump. A schematic of the apparatus used to conduct the wear test is shown in FIG. 3. A heat exchanger was used to maintain a constant temperature of the water circulating through the loop. A transparent viewing section was provided so that the condition of the logs during the wear test could be visually observed. The coal logs were subjected to the water absorption test before the wear test, so that the logs were saturated with water and would not absorb additional water while being tested in the pipe. This made it possible to determine wear rate based on the weight loss of the logs circulated through the pipe. The logs were inserted into the loop and taken out of the loop through a window in the pipe located in a constant-head reservoir. The water velocity in the recirculating pipeline loop was set at the lift-off velocity, $V_L$, calculated from the following equation:

$$V_L=7.2[(S-1)ag(1-k^2)kD]^{0.5}$$

where S is the specific gravity of the log; g is gravitational acceleration; a is the aspect ratio which is the log length divided by the log diameter; k is the diameter ratio which is the log diameter divided by the pipe inner diameter; and D is the inner diameter of the pipe. The lift-off velocity is the minimum velocity at which a coal log or capsule becomes totally suspended by the flow of circulating liquid, with the front end of the log (capsule) raised at an angle-of-attack. Experience has shown that both head loss and wear rate are at a minimum when coal log pipelines are operated at a velocity slightly below the lift-off velocity. Periodically, the flow was stopped and the logs were taken out of the loop through the window for weighing to determine weight loss. The tests were continued until the logs broke in the pipe. The weight loss of coal logs at various circulation time or various number of cycles of circulation was then plotted to study wear rate.

Figure 4:
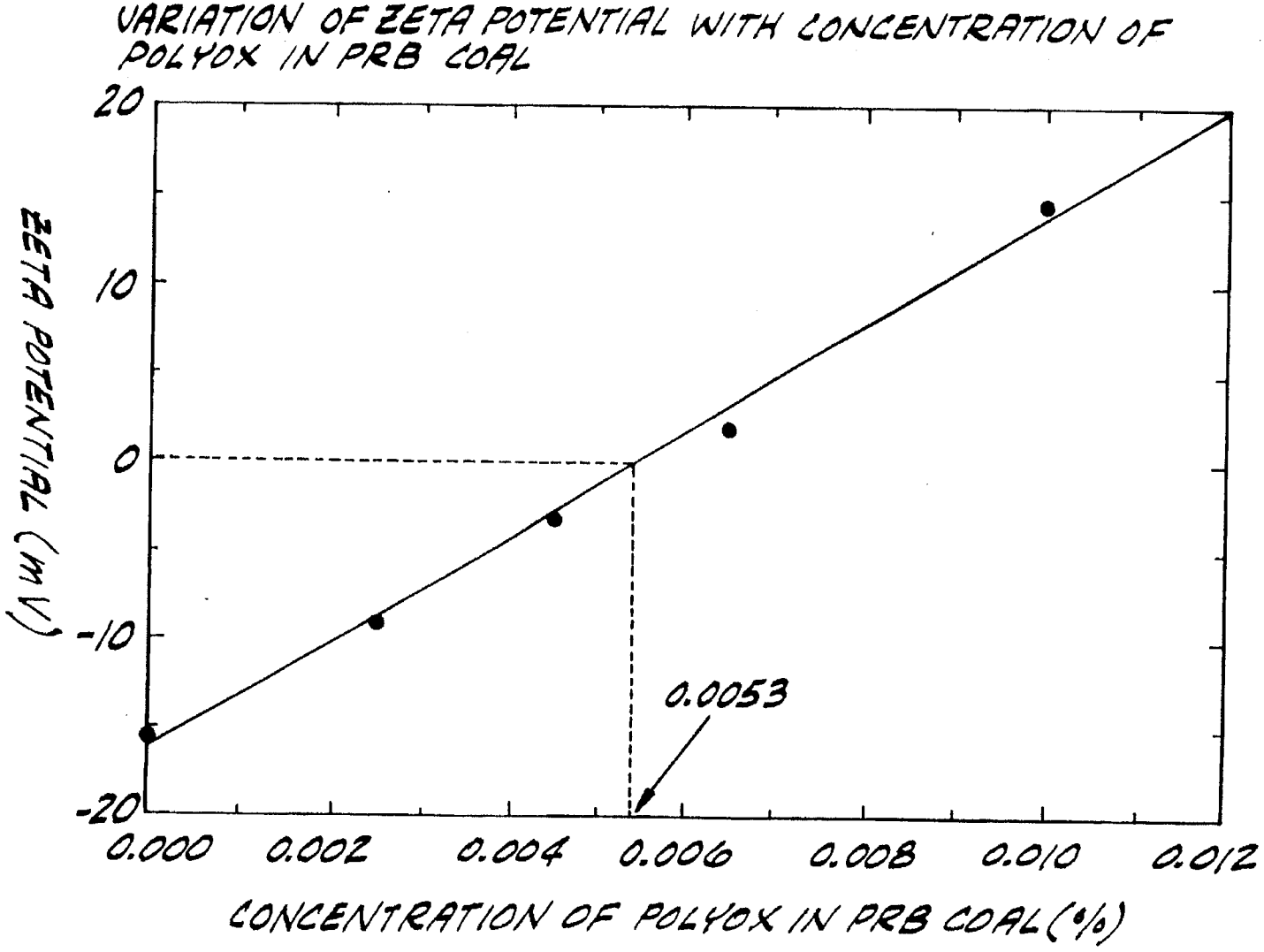
FIG. 4 is a graph showing the effect of the concentration of POLYOX in the feed mixture on the zeta potential of the feed mixture in Example 3.
Figure 5:
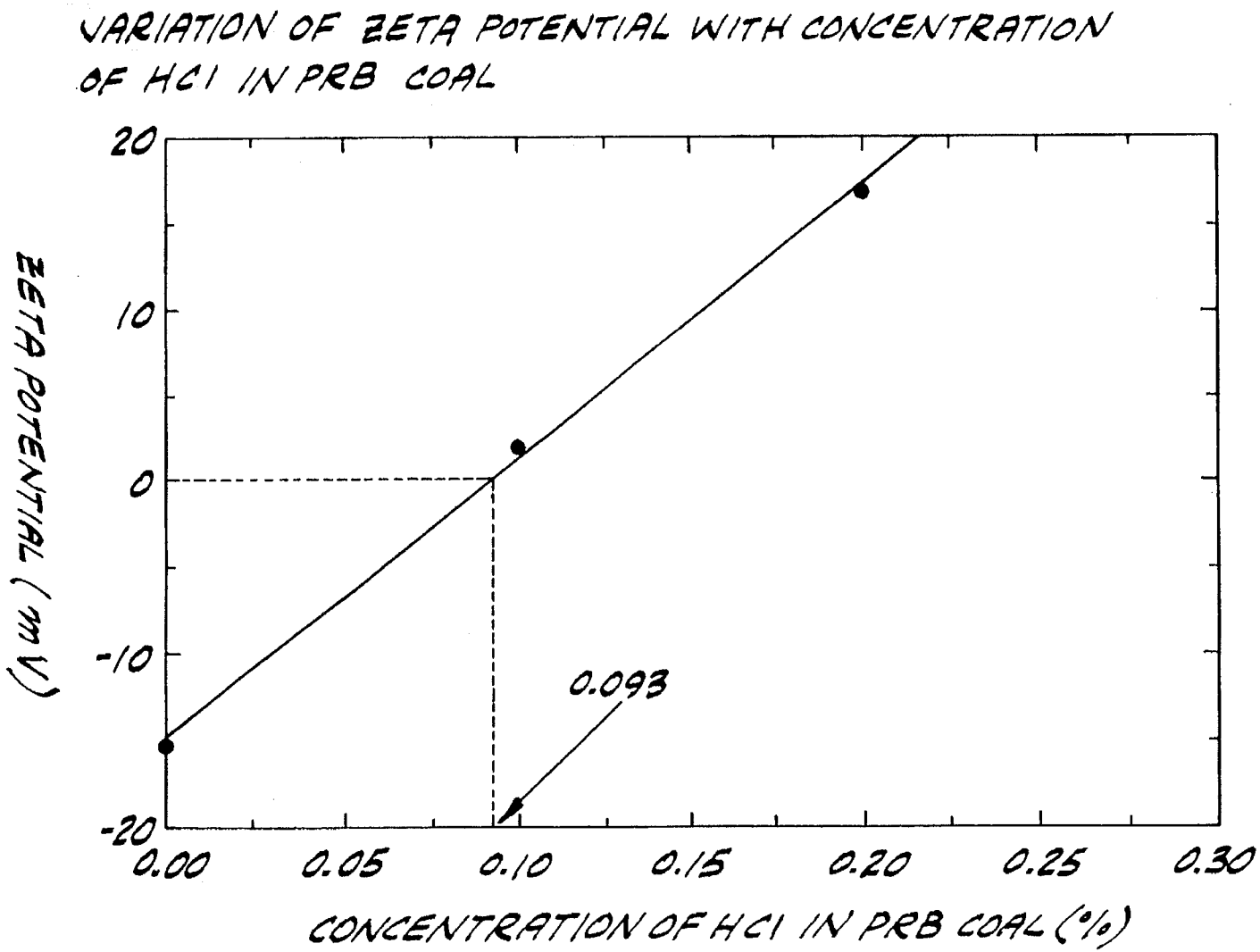
FIG. 5 is a graph showing the effect of the concentration of hydrochloric acid in the feed mixture on the zeta potential of the feed mixture in Example 3.

The effects of POLYOX and hydrochloric acid on the zeta potential of the Powder River Basin coal feed mixtures are shown in FIGS. 4 and 5. In the experiments, the zeta potential of the feed mixtures was changed by the POLYOX and hydrochloric acid additions from about −15.5 (for the feed mixture containing only coal and deionized water) to about 17 mV. Each set of data contains two specimens corresponding to feed mixtures containing 25 and 45 wt % water. The values of both and their average are indicated by the bars in the ensuing Figures.

Effect of Zeta Potential on Density of Coal Logs

Figure 6:
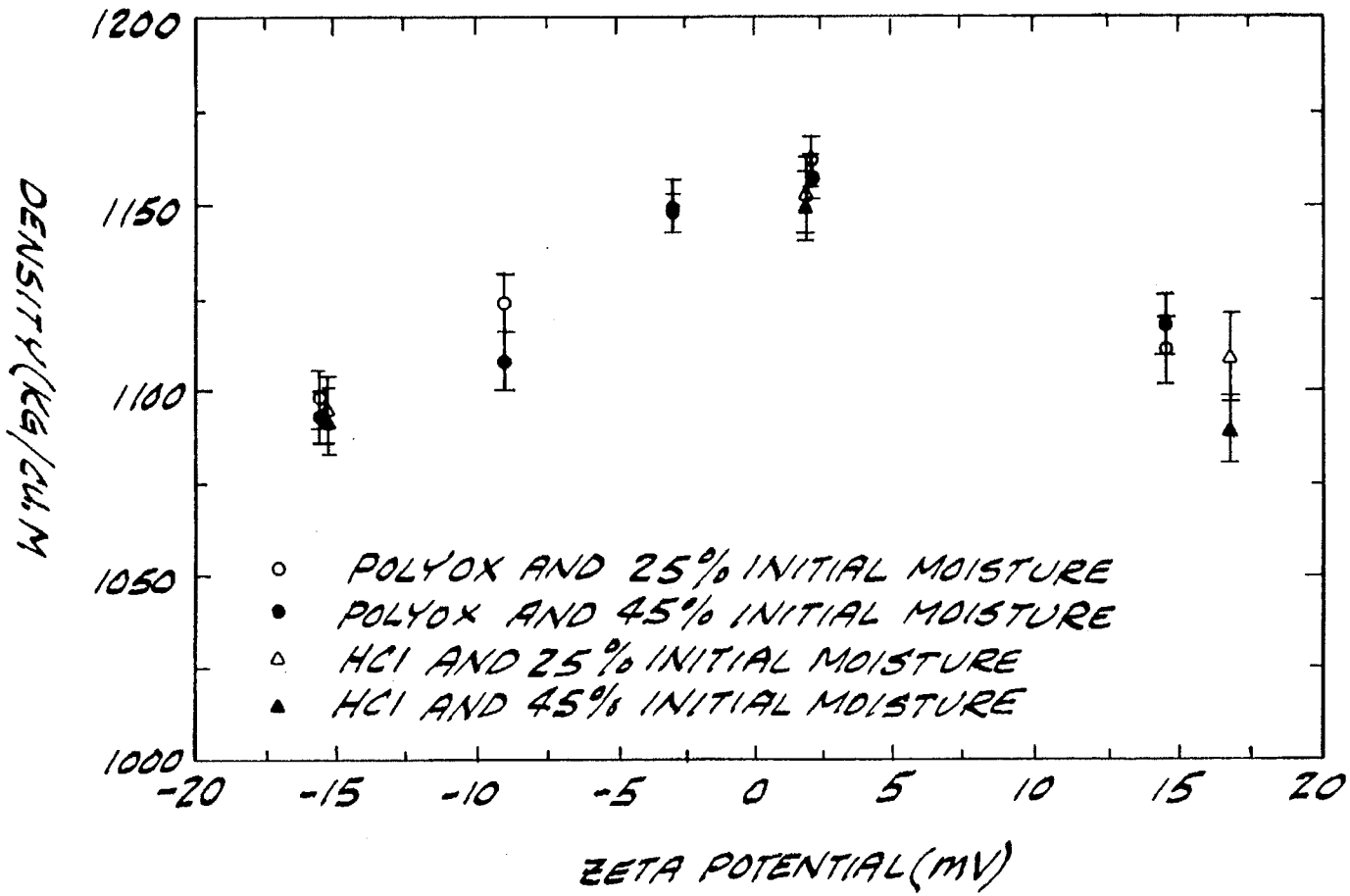
FIG. 6 is a graph showing the effect of zeta potential of the feed mixture on the density of coal logs produced from the feed mixture in Example 3 prior to water absorption.

FIG. 6 shows the effect of zeta potential of the feed mixture on the density of coal logs produced from the mixture before the water absorption test. When the zeta potential of feed mixture approached zero from either a positive or negative potential, a maximum coal log density of about 1160 kg/m$^3$ was attained. The densities of coal logs formed from feed mixtures without neutralized zeta potentials were in the range from about 1092 to about 1095 kg/m$^3$. More specifically, the densities of the coal logs increased 5.9% (POLYOX, 25 wt % water in feed), 6.0% (POLYOX, 45 wt % water in feed), 5.3% (hydrochloric acid, 25 wt % water in feed), and 5.3% (hydrochloric acid, 45 wt % water in feed) as the zeta potential of the feed mixture was neutralized. This indicates that under identical condition, the coal logs formed from feeds having neutralized zeta potentials were compacted to a density of 5% to 6% higher than those formed from feeds without zeta potential neutralization. This result supports the hypothesis that neutralizing zeta potential of the feed mixture enhances coal log compaction.

Effect of Zeta Potential on Water Absorption of Coal Logs

Figure 7:
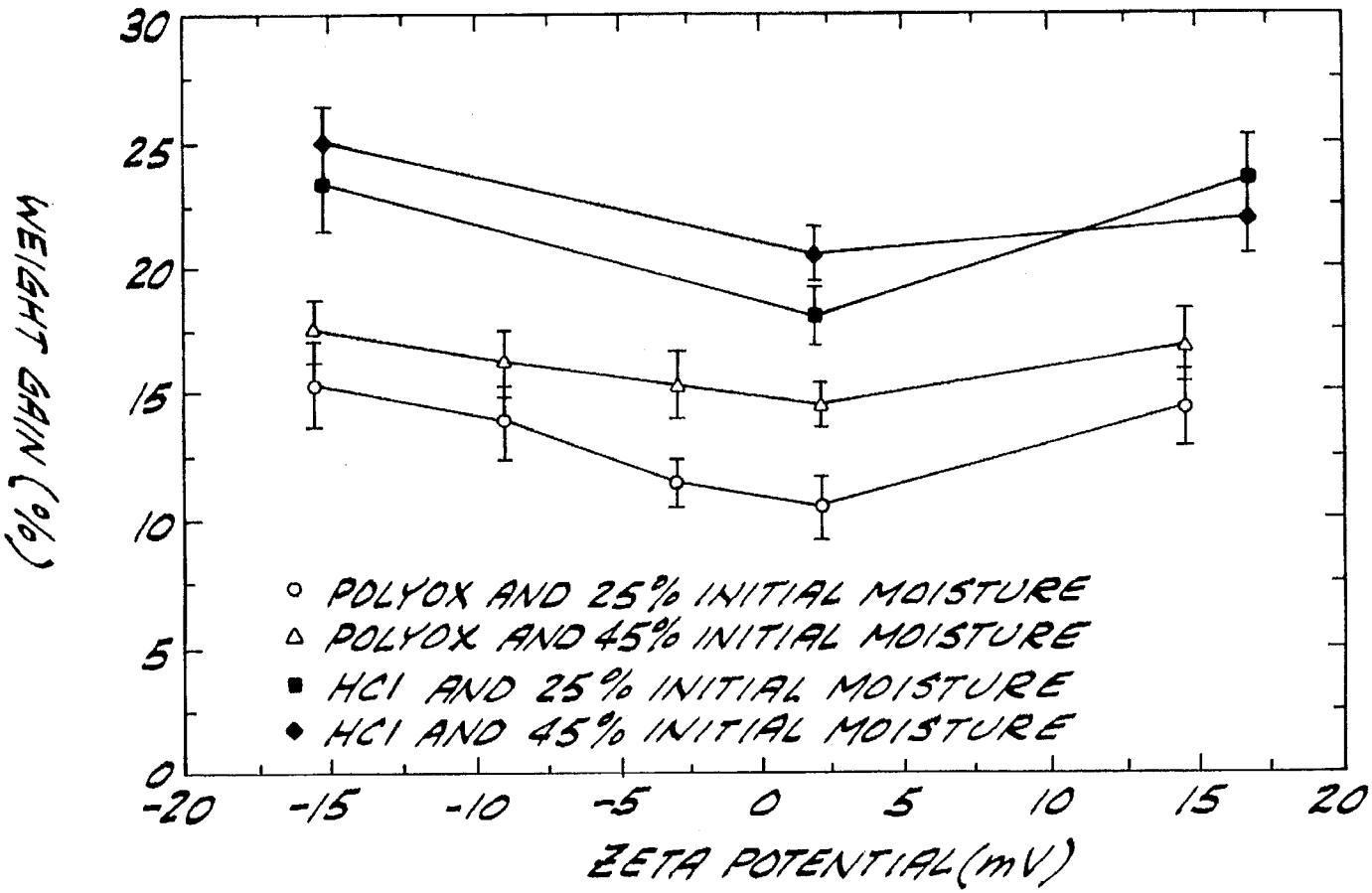
FIG. 7 is a graph showing the effect of zeta potential of the feed mixture on weight gain of coal logs produced from the feed mixture due to the water absorption test in Example 3.

The water absorption test resulted in the coal logs gaining weight. FIG. 7 shows the effect of zeta potential of the feed mixture on weight gain of coal logs produced from the feed mixture due to the water absorption test. When the zeta potential of the feed mixture was neutralized, the weight gains of the coal logs decreased to a minimum. The coal logs formed from feed mixtures with nearly neutralized zeta potentials absorbed 11.5 wt % water (POLYOX, 25 wt % water in feed), 15.0 wt % (POLYOX, 45 wt % water in feed), 14.1% (hydrochloric acid, 25 wt % water in feed) and 16.5% (hydrochloric acid, 45 wt % water in feed) after one hour immersion in water at 3447 kPa gauge. This corresponds to a reduction of water absorption by approximately 25, 14, 23, and 19%, respectively, compared to those logs formed from feed mixtures without neutralized zeta potentials. The reduced water absorption is due to smaller porosity in the coal logs resulting from better compaction. This is consistent with the finding in the previous section that neutralizing the zeta potential of the feed mixture produces denser logs. Generally, higher density coal logs have lower porosity, and they absorb less water.

Effect of Zeta Potential on Tensile Strength of Coal Logs

Figure 8A:
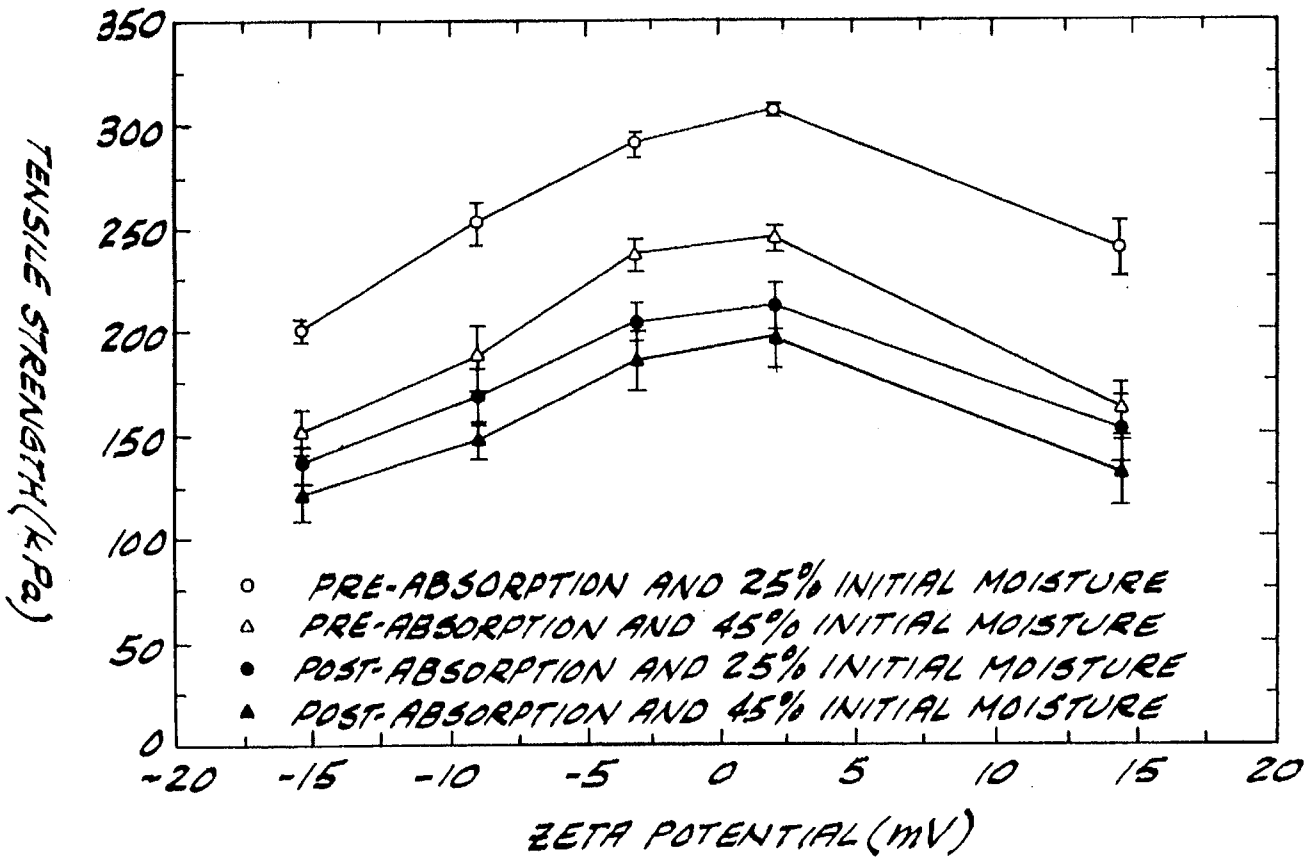
FIG. 8(*a*) is a graph showing the effect of zeta potential of the feed mixture on the splitting tensile strength of the coal logs produced from the feed mixture in Example 3 using POLYOX as a zeta potential modifying agent in the feed mixture.
Figure 8B:
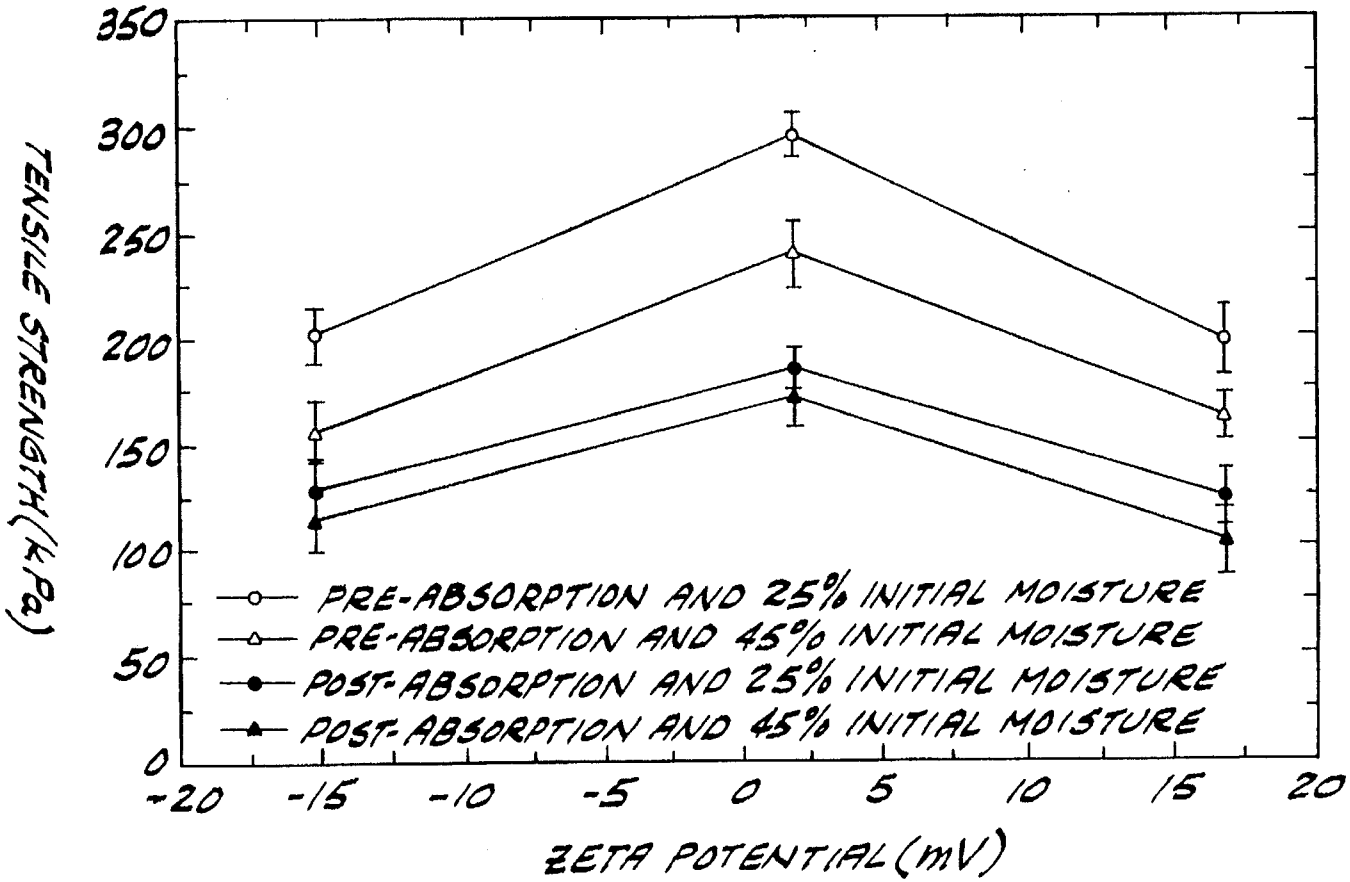

FIGS. 8(*a*) and 8(*b*) illustrate the effect of zeta potential of the feed mixture on the splitting tensile strength of coal logs produced from the feed mixture. When the zeta potential approached zero from positive or negative, the tensile strength of the logs also approached a maximum regardless whether the zeta potential modifying agent added to the feed mixture was POLYOX or hydrochloric acid and regardless of the initial moisture content of the feed (i.e., 25 or 45 wt %). Before water absorption, the tensile strengths of coal logs produced from feeds without neutralized zeta potential were 200.6 to 209.5 kPa for feeds having an initial water content of 25 wt %, and 150.7 to 155.6 kPa for feeds having an initial water content of 45 wt %. The corresponding tensile strengths of the coal logs produced from feeds with neutralized zeta potentials were 307.2 kPa (POLYOX, 25 wt % water in feed), 295.6 kPa (hydrochloric acid, 25 wt % water in feed), 245.0 kPa (POLYOX, 45 wt % water in feed), and 232.7 kPa (hydrochloric acid, 45 wt % water in feed). This means as the zeta potential changed from −15.5 mV to zero, the tensile strength of the coal logs increased 53% (POLYOX) and 45% (hydrochloric acid) for feeds having an initial moisture content of 25 wt %, and increased 63% (POLYOX) and 54% (hydrochloric acid) for feeds having an initial moisture content of 45 wt %. The tensile strength of coal logs measured after water absorption also increased when the zeta potential was neutralized. The increase in tensile strength after water absorption was 57% (POLYOX, 25 wt % water in feed), 44% (hydrochloric acid, 25 wt % water in feed), 69% (POLYOX, 45 wt % water in feed), and 51% (hydrochloric acid, 45 wt % water in feed). The foregoing data indicate that coal logs produced from feeds having neutralized zeta potentials were approximately 50% stronger in tensile strength.

Effect of Zeta Potential on Weight Loss of Coal Logs in Wear Tests

Figure 9A:
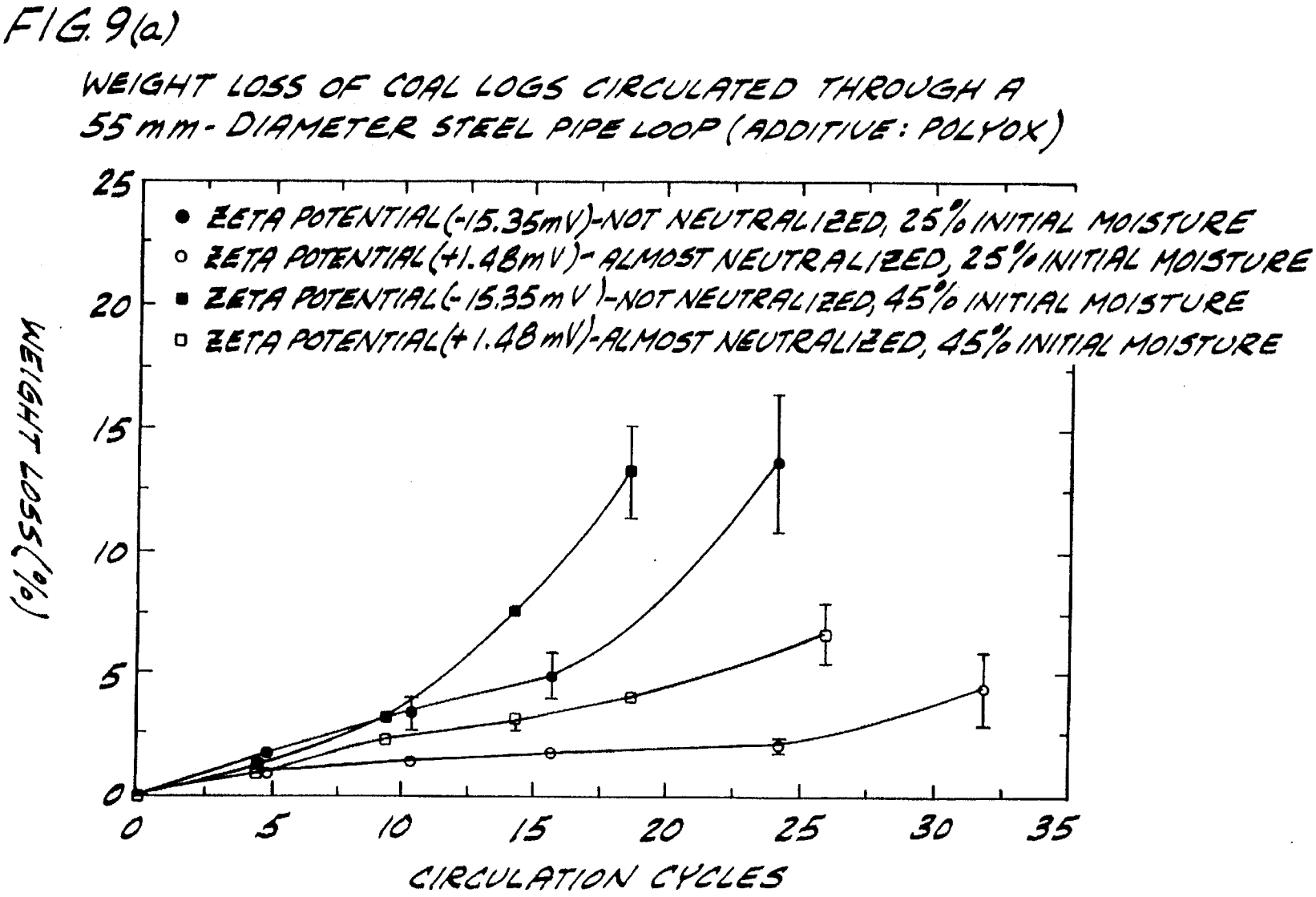
FIG. 9(*a*) is a graph showing the effect of zeta potential of the feed mixture on the weight loss of coal logs produced from feeds containing POLYOX as a zeta potential modifying agent upon being subjected to the wear test in Example 3 as a function of the number of cycles through the recirculating pipe loop.
Figure 9B:
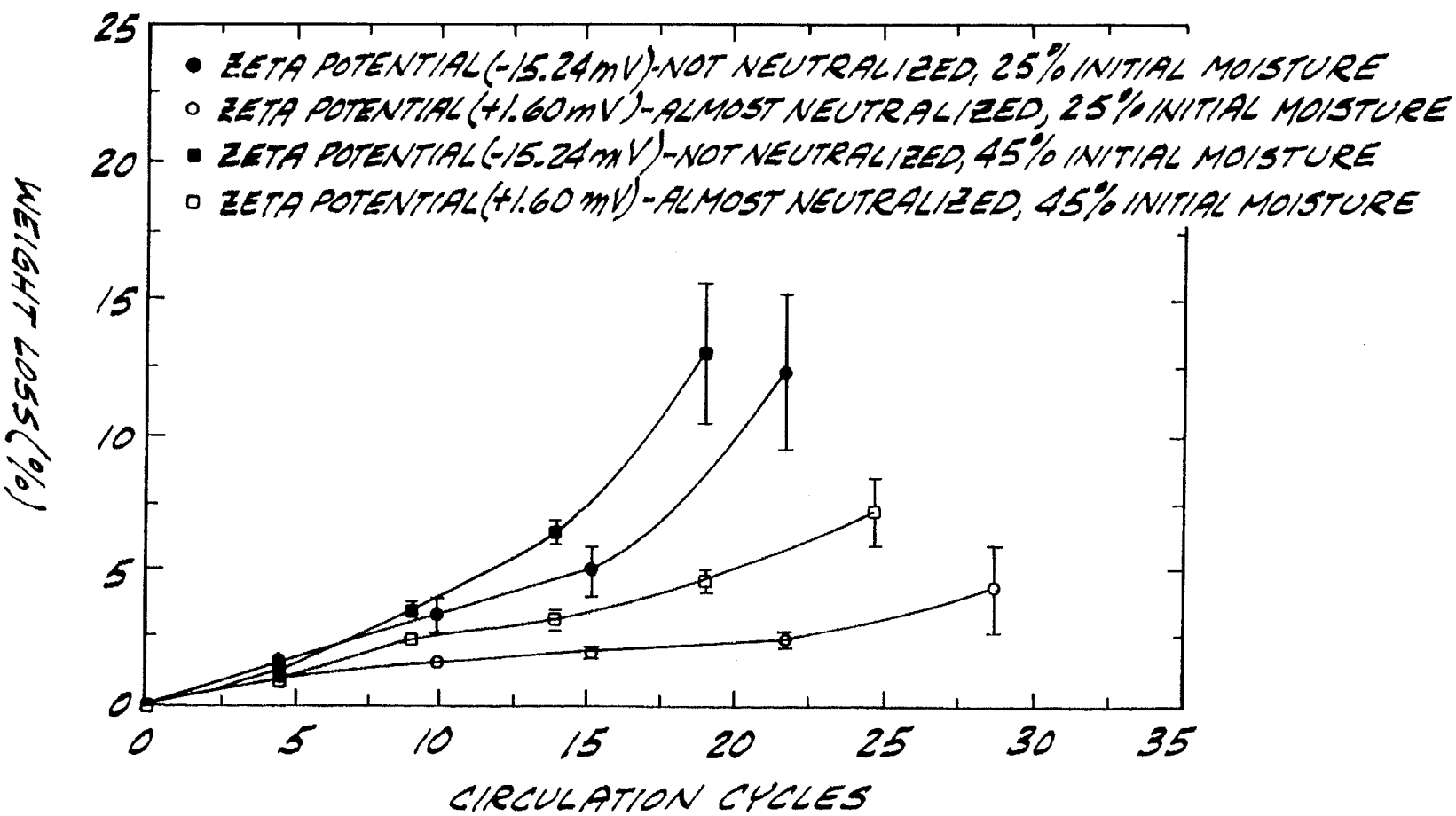

FIGS. 9(*a*) and 9(*b*) show the effect of zeta potential of the feed mixture on the weight loss of coal logs produced from the feed mixture upon being subjected to the wear test as a function of the number of cycles through the recirculating pipe loop. The pipe loop was driven by a jet pump which caused the coal logs to bang on the pipe wall whenever they pass through the jet pump. Furthermore, during each cycle of circulation, the coal logs were passed through two 180° bends. Both the jet pump and the bends are abrasive to coal logs. Commercial coal log pipelines do not use jet pumps and hence are less abrasive than the circulation loop used to conduct the wear test. The coal logs formed from feeds having neutralized zeta potentials had minimum weight losses due to wear. After 24 cycles of circulation, the average weight losses of the coal logs made from feeds without and with zeta potential modification by POLYOX were 13.7 and 2.1 wt %, respectively, for feeds having an initial moisture content 25 wt %, and 13.2 and 4.0 wt %, respectively, for feeds having an initial moisture content of 45 wt %. This yields a nearly seven fold decrease in wear for logs compacted from feeds having an initial moisture content of 25 wt %, and over a three fold decrease in wear for logs compacted from feeds having an initial moisture content of 45 wt %. After 19 cycles of circulation, the weight losses of the coal logs with zeta potentials neutralized by hydrochloric acid additions decreased by a factor 5 for feeds having an initial moisture content of 25 wt % and decreased by a factor of 3 for feeds having an initial moisture content of 45 wt % as compared to those logs formed from feeds without neutralized zeta potentials. This indicates that coal logs produced from feeds with neutralized zeta potentials are far more wear resistant than those produced from feeds without neutralized zeta potentials.

In this Example, the zeta potential of feeds containing Powder River Basin coal was changed by adding a small amount of POLYOX or hydrochloric acid as a zeta potential modifying agent. FIGS. 4 and 5 show the relationship between the zeta potential of the feed and the concentration of the additives in the feed. For neutralizing the zeta potential of the feed, 0.0053 wt % of POLYOX and 0.093 wt % of hydrochloric acid were needed. The wholesale price of POLYOX is approximately $11 per kg, and the wholesale price of hydrochloric acid is approximately $1 per kg (OPD Chemical Buyers Dictionary, 1995). To neutralize one ton (1000 kg) of the Powder River Basin feed about 0.053 kg of POLYOX and 0.93 kg of hydrochloric acid must be added at a cost of $0.58 and $0.93, respectively. This shows that it is more economical to use POLYOX than hydrochloric acid as a zeta potential modifying agent and for producing stronger and more wear-resistant coal logs. POLYOX has the additional advantages of being effective in reducing the drag (energy loss) of compacts transported in a coal log pipeline, not making the feed acidic, and burning without generating pollutants since it is free of pollutant precursors, such as nitrogen and sulfur compounds.

This Examples demonstrates that neutralizing the zeta potential of feed mixtures results in denser, stronger, more water-resistant and more wear-resistant coal logs. However, the study was limited to binderless coal logs compacted at room temperature. Such logs, even when strengthened by neutralizing the zeta potential, are still not sufficiently wear-resistant to ensure long-distance hydraulic transport by pipelines. Nonetheless, the logs compacted from feeds having neutralized zeta potentials appear to be as strong as and as wear-resistant as commercial briquettes. Such logs are expected to be suitable for transportation by trucks, trains, barges, and conveyor belts—the same way coal briquettes are usually transported.

Other investigations have demonstrated that strong coal logs that are highly resistant to wear in pipeline can be produced by either raising the temperature of coal during compaction, by using a binder added to the feed material, or through a combination of both higher temperatures and binder addition. However, the costs of binder and elevated processing temperature for making good coal logs are relatively high (e.g., greater than $1.00 per ton of coal). Results from this Example show that these processes that produce wear-resistant logs can be modified to produce equally wear-resistant logs for pipeline transportation at lower temperature or with using a lower amount of binder if the zeta potential of the feed mixture is neutralized.

Zeta potential is an important factor affecting coal log compaction and coal log quality. Neutralizing the zeta potential of the feed mixture results in a stronger compact with lower porosity, higher density, less water absorption, greater tensile strength and better wear resistance. The effect is attributed to the reduced repelling force between coal particles in the feed, making it possible to bring coal particles closer to each other during compaction, thereby forming a stronger bond between coal particles and a stronger compact.

In view of the above, it will be seen that the several objects of the invention are achieved. As various changes could be made in the above-described process without departing from the scope of the invention, it is intended that all matter contained in the above description be interpreted as illustrative and not in a limiting sense.

What is claimed is:

1. A process for making a compact from a feed material comprising carboniferous particles and water, the process comprising:

determining the zeta potential of said feed material;

reducing, if necessary, the zeta potential of said feed material such that said feed material has a zeta potential of less than about 10 millivolts and greater than about −10 millivolts; and thereafter applying a compressive stress to said feed material to form said feed material into said compact.

2. The process of claim 1 wherein said compressive stress is not in excess of about 20,000 psig.

3. The process of claim 2 wherein the zeta potential of said feed material is reduced by adding a water-soluble, zeta potential modifying agent to said feed material, said modifying agent being selected from the group consisting of acids, bases, polymers, surfactants, and electrolytes.

4. The process of claim 3 wherein said zeta potential is reduced by adding polyethylene oxide to said feed material.

5. The process of claim 1 wherein said feed material comprises particulate coal fines and water, said coal fines predominantly having a size of less than about 1 millimeter.

6. The process of claim 1 wherein said feed material has a zeta potential which is greater than about 10 millivolts or less than about −10 millivolts prior to said reduction step and a zeta potential of less than about 5 millivolts and greater than about −5 millivolts after said reduction step.

7. The process of claim 6 wherein said feed material has a zeta potential which is greater than about 10 millivolts or less than about −10 millivolts prior to said reduction step and a zeta potential of less than about 2 millivolts and greater than about −2 millivolts after said reduction step.

8. A process for preparing a compact from a feed material comprising carboniferous particles and water, the process comprising:

selecting a compressive stress greater than about 5,000 psig which will be applied to said feed material to form said compact, said feed material having a moisture content such that when said selected compressive stress is applied to said feed material water is expressed from said feed material;

determining the zeta potential of said feed material;

reducing, if necessary, the zeta potential of said feed material such that said feed material has a zeta potential of less than about 10 millivolts and greater than about −10 millivolts; and thereafter applying said selected compressive stress to said feed material to form said feed material into said compact.

9. The process of claim 8 wherein the compressive stress is not in excess of about 20,000 psig.

10. The process as set forth in claim 8 wherein the moisture content of said feed material is increased such that when said selected compressive stress is applied to said feed material water is expressed from said feed material.

11. The process of claim 10 wherein said feed material is tempered for a period of at least 10 minutes after the moisture content of said feed material is increased.

12. The process of claim 11 wherein said feed material is tempered for a period of at least 1 hour after the moisture content of said feed material is increased.

13. The process of claim 8 wherein said feed material has a zeta potential which is greater than about 10 millivolts or less than about −10 millivolts, said zeta potential of said feed material being reduced to less than about 5 millivolts and greater than about −5 millivolts prior to applying said selected compressive stress to said feed material.

14. The process of claim 13 wherein said feed material has a zeta potential which is greater than about 10 millivolts or less than about −10 millivolts, said zeta potential of said feed material being reduced to less than about 2 millivolts and greater than about −2 millivolts prior to applying said selected compressive stress to said feed material.

15. The process of claim 8 wherein said feed material comprises particulate coal fines and water, said coal fines predominantly having a size of less than about 1 millimeter.

16. The process of claim 8 wherein said feed material is compressed into said compact by extrusion.

17. The process of claim 8 wherein the compressive stress applied to said feed material is maintained until at least about 95 weight percent of the amount of water which can be expressed from said feed material under said selected compressive stress is expressed from said feed material.

18. A process for making a compact from a feed material comprising carboniferous particles and water, the process comprising:

determining the zeta potential of said feed material;

reducing, if necessary, the zeta potential of said feed material by adding a water-soluble, zeta potential modifying agent to said feed material such that said feed material has a zeta potential of less than about 10 millivolts and greater than about −10 millivolts; and thereafter applying a compressive stress to said feed material to form said feed material into said compact.

19. A process for making an extrudate from a feed material comprising carboniferous particles and water, the process comprising applying an extrusion force to said feed material to force said material through a die of an extrusion apparatus and form said extrudate, said extrudate exiting said die into a cell comprising a liquid, said liquid being maintained at a pressure less than the die pressure of said extrusion apparatus such that said extrudate is forced through said die and into said liquid.

20. The process of claim 19 wherein said pressurized liquid is water.

* * * * *